United States Patent [19]

Stoltz

[11] Patent Number: 4,817,225

[45] Date of Patent: Apr. 4, 1989

[54] SWIMMING POOL CLEANING DEVICE

[75] Inventor: Herman Stoltz, Pretoria, South Africa

[73] Assignee: Automated Pool Cleaners (Pty) Ltd., Transvaal Province, South Africa

[21] Appl. No.: 181,666

[22] Filed: Apr. 14, 1988

[30] Foreign Application Priority Data

Apr. 16, 1987 [ZA] South Africa ..... 87/2731

[51] Int. Cl.[4] ..... F04H 3/20

[52] U.S. Cl. ..... 15/1.7; 15/404

[58] Field of Search ..... 15/1.7, 404; 210/169

[56] References Cited

U.S. PATENT DOCUMENTS 3,054,131 9/1962 Groves ..... 15/404 X 3,803,658 4/1974 Raubenheimer ..... 15/1.7

4,023,227 5/1977 Chauvier ..... 15/1.7

4,133,068 1/1979 Hofmann ..... 15/1.7

*Primary Examiner*—Edward L. Roberts

*Attorney, Agent, or Firm*—Birch, Stewart, Kolasch & Birch

[57] ABSTRACT

The invention relates to a cleaning device particularly a swimming pool cleaner for automatically cleaning submerged surfaces in which an induced flow through the cleaner is intermittently interrupted to cause random movement of the cleaner over the surface to be cleaned and in which a valve is freely movable towards and away from a valve seat in a flow passage through the cleaner. Preferably the closure member is spherical and has a specific gravity only slightly greater than that of the liquid in which the device is to be used.

10 Claims, 2 Drawing Sheets

SWIMMING POOL CLEANING DEVICE

This invention relates to a device suitable for cleaning a surface submerged in a liquid, including in particular for example the case of a swimming pool.

Many swimming pool cleaners have been derived and some of them utilising the suction induced through a flexible hose to the standard filtration unit for the pool. Intermittent interruption of the flow through the flexible hose from the pool cleaner results in forces which move the cleaner in stepwise and random manner over the surface to be cleaned.

Some of these cleaners are protected by for example the following U.S. Pat. Nos.:

| | |
|---|---|
| 3,803,658 | Raubenheimer |
| 4,023,227 | Chauvier |
| 4,133,068 and 4,208,752 | Hofmann and |
| 4,642,833 | Coxwold (Pty) Limited. |

All of these and others known to the applicant use a valve which is held in position to open and close at least one flow passage through the pool cleaner into the flexible suction hose.

It is the object of the present invention to provide a swimming pool cleaner which operates using the principle of an interruption in an induced flow through the cleaner, but which has a valve mechanism in which the valve is free to move in a chamber including the valve seat. Such a construction has shown in the applicant's experience effective operation and a minimum tendency for the cleaner to become inoperative through the trapping of debris therein during normal use.

According to this invention there is provided a device for cleaning surfaces submerged in a liquid comprising a surface contacting head an inclined passage for flow of liquid through the head an entrance for flow into the head and an outlet for flow from the head providing at its upstream end a closure valve seat for the outlet, a closure member free to move in the head towards and away from the valve seat and a hollow axially contractable member connected to the outlet at one end with its other end suitable for connection to a flexible suction hose.

Further features of this invention for the closure member to have a rounded seating surface, for the seat or the closure member or both to be resilient and for a rigid tube to form an extension between the outlet and the hollow axially contractable member.

In use the head may be adapted by means of a flexible disc surrounding the inlet to clean as the head sweeps over the surface with the device outlet connected via the flexible hose to a pump inlet to set up the flow of liquid through the apparatus. The pump is preferably that used in the filtration equipment for a swimming pool.

The axially contractable member can be a resilient diaphragm or other concertinering resilient coupling, interposed in the connection between the device and the flexible hose so as to reduce the transmission of impulsive movements of the device to th flexible hose. In the embodiment applicable to cleaning a swimming pool the device will hereafter simply be referred to as a "swimming pool cleaning device".

According to another embodiment of the invention there is provided a swimming pool cleaning device operable by a swimming pool suction filtration pump, the device comprising a cleaning head, a water inlet, a flexible member surrounding the inlet for contacting a surface to be cleaned, a water outlet, a flow passage for water between the inlet and the outlet, the outlet having means for connection, through a suitable flexible hose, to the inlet opening of a swimming pool filtration pump to induce a flow of water in the flow passage from the inlet to the outlet during use and a valve in the flow passage the valve comprising a valve seat and a closure member upstream of the seat and freely movable by water flow through the passage to come into contact with the valve seat, thereby to close the valve, and to rebound from the valve seat, thereby to open the valve.

Preferably the closure member is spherical. Alternatively, it may have any other external profile such that the flow of water around the closure member results in turbulence or backflow of fluid downstream of the closure member.

The closure member may be oval-shaped or cylindrical, with rounded ends. It may further include means for maintaining the closure member in a desired axial orientation relative to the valve seat so that a predetermined face or side of the closure member will come into contact with the valve seat.

The closure member or the valve seat may be of a resilient material to assist in the rebounding of the closure member from the valve seat during use. In one particular embodiment of the invention, the valve seat may be of a substantially rigid material and the closure member may be of a resilient material.

The flow channel may, at least along part of its length, be defined by a rigid cylindrical or tubular member, particularly in a region immediately downstream of the valve.

Preferably the valve closure member will have a specific gravity slightly above that of the liquid in which the cleaning device is to operate. This will be from above 1 to 1.1 for swimming pool cleaners.

The inlet to the flow passage will preferably be normal to the surface to be cleaned during use and for there to be an additional inlet above the flexible member into the flow passage.

A preferred embodiment of the invention as applied to a swimming pool cleaner will be described below with reference to the accompanying diagrammatic drawings in which.

Figure 5:
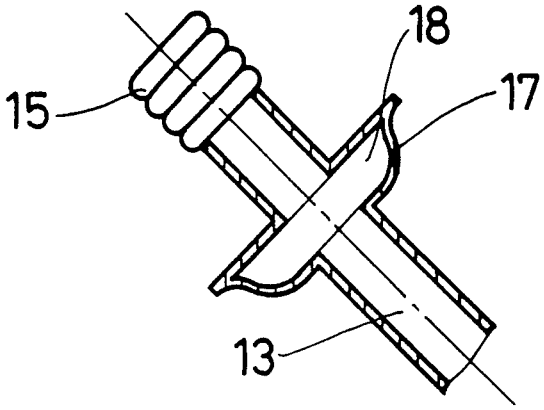

FIG. 5 an alternative axially contractable member.

Figure 1:
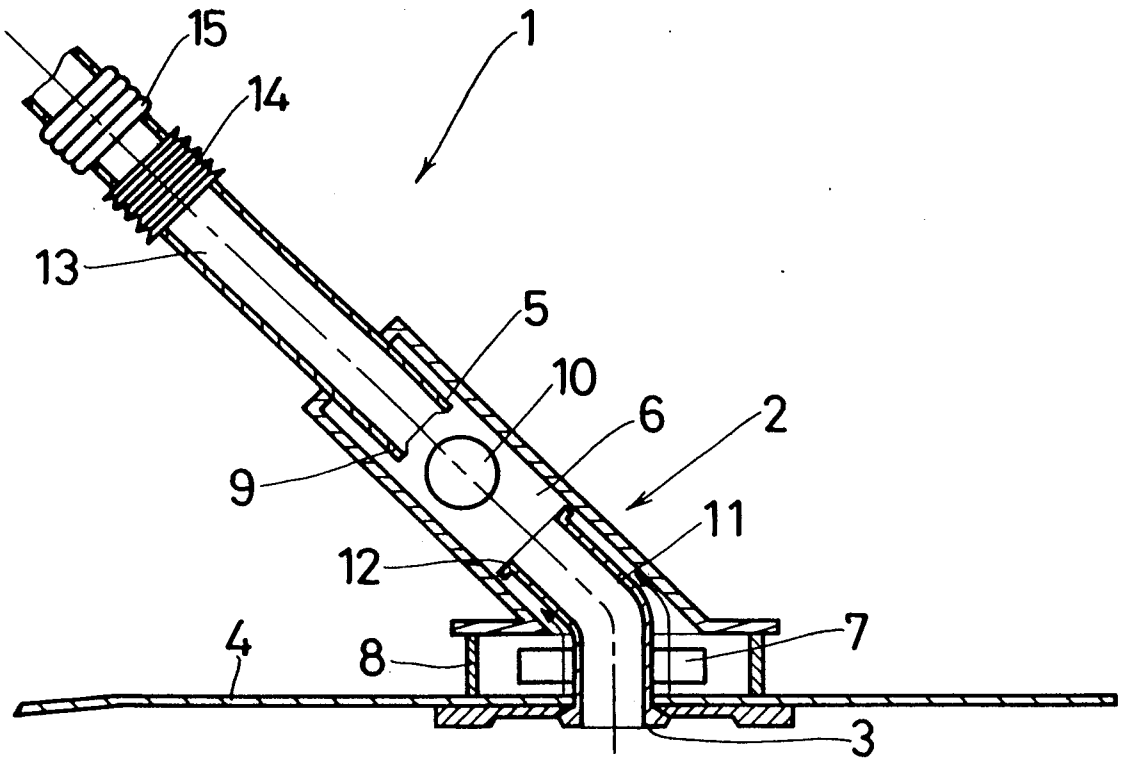
FIG. 1 is a sectional side elevation of a swimming pool cleaner.

Referring to FIG. 1 reference numeral 1 generally indicates a swimming pool cleaning device comprising a head 2 having a fluid inlet 3, a flexible membrane 4 surrounding the inlet 3, a fluid outlet 5 and a flow passage 6 between the inlet 3 and the outlet 5.

The head 2 is also provided with a port 7 above the flexible membrane 4 serving as an additional inlet for water to the head 2. The inlet 3 is through a foot 8 which engages against a surface to be cleaned during use and the flow passage 6 is inclined to the axis of the inlet at about 45°. The outer surface of the foot 8 is stepped to enable water to flow into the inlet 3.

The outlet 5 from the flow passage 6 defines a valve seat 9 which is co-axial with the flow passage. Within the flow passage is housed a spherical valve closure member 10. The diameter of the closure member 10 may in a practical example be about 40 mm and the flow passage can be circular with a diameter of 55 to 60 mm. The length of the passage in which the closure member 10 is free to move is about 100 mm. These dimensions will give the cleaner its overall proportions.

The closure member is preferably made of suitable resilient plastics material having a specific gravity slightly above that of water. For example this specific gravity will be in excess of 1 but not above 1.1. This will ensure that when the cleaner is not in use the closure member will fall away from the valve seat.

Part of the flow passage from the foot 8 is made as a tube 11 which extends into the flow passage 6 and acts as a stop at 12 beyond which the closure member 10 cannot move in the passage.

The outlet from the flow passage 6 forms a valve seat 9 with which the member 10 co-operates in use to prevent flow through the head 2. The valve seat may also be of resilient material.

The flow passage 6 is extended beyond the head 2 in the form of a rigid tube 13. Connected on the end of this tube 13 is a co-axial resilient bellows member 14. This bellows 14 may include a light compression spring to give it the required resilience in operation as described below. The bellows member 14 is adapted at its free end to be connected to the conventional suction hose 15 of swimming pool filtration equipment.

The length of tube 13 is also chosen to suit operating conditions.

The parts of the cleaner are preferably moulded from suitable plastics material and depending on that chosen the cleaner may also be provided with balancing and flotation components as is known for this type of equipment. As they form no part of this invention except in combination they have not been illustrated.

In use, the outlet 5 is connected to a flexible suction hose 15 which in turn is connected to the suction opening of a swimming pool filtration pump (not shown).

When suction is applied to the outlet 5 water flows through the flow passage 6. This flow urges the ball forming the closure member 10 against the valve seat 9 but due to the profile of the ball, it is believed that turbulance or backflow results downstream of the ball. This may exert a force on the ball opposite to the main direction of flow, which it is believed assists in the ball rebounding from the valve seat 9, thereby again opening the valve. Flow again takes place through the head 2 and the process is repeated. Whatever the scientific reason, it is found that by appropriate experimental choice of dimensions and suction pressures the closure member moves repeatedly onto and away from the valve seat 9.

The result of the above is the closure member exerts a pulsating action on the valve seat 9 alternately and repeatedly opening and closing the flow passage 6 to the flow of water therethrough. This pulsating action alternately and repeatedly results in the flexible membrane being sucked against and released from the submerged surface being cleaned to loosen dirt and sediment which is drawn through the flow passage 6 and into the pool filter.

The pulsating action and the resultant forces acting on the cleaner and in the hose cause intermittent contraction of the suction hose, enabling random movement of the device to take place over submerged surface, thereby to clean the whole surface.

The rebounding of the ball closure member 10 from the valve seat 9 can also be assisted or accentuated by making the valve seat 9 or the ball 10 or both of a resilient material. In the embodiment illustrated, the valve seat 9 is of a rigid material and the ball 10 is of a resilient material.

It has been found that the frequency of the pulsations is influenced by the length and diameter of the tube 13, as well as the diameter and length of the flow passage 6 in the head 2 in which the ball 10 is located. These parameters may be selected to provide a desirable pulse rate to suit a particular application.

It has also been found by the applicant that the bellows member 14 acts as a shock absorber or cushion to reduce the intensity of the pulsating action on the device being transferred to the suction hose, as may be desired in practice.

When the suction is relieved the ball 10 will fall away from valve seat 9 and come to rest against the stop 12. This enables the cleaner to be brought back into operation immediately the suction is re-applied to the flexible hose.

As can be seen from FIG. 1 the closure member 10 is not connected to any member and it is capable of free movement in the flow passage 6 between the valve seat 9 and the stop at 12. It has been found that the ball 10 rotates or spins when executing the closing and opening actions so that the same side of the ball 10 is not continuously brought into contact with the valve seat 9. This will result in even wear and long life to the closure member 10.

Because the closure member 10 oscillates freely during use in a comparatively large volume it has been found that debris entrained in water flowing through the cleaner during use does not become trapped in the valve assembly and interfere with proper operation of the cleaner. There are no mechanical constraints on the member 10 and the cleaner has been found to operate in a very satisfactory manner even at low suction pressures.

The bellows member 14 and if necessary the compression spring can also be chosen and adjusted to maximise the operation of the cleaner as can the length of the tube 13.

It will be appreciated that the valve closure member 10 need not be a sphere, as is illustrated in FIG. 1, but that any closure member having a profile which will result in a rebounding thereof from the valve seat, due to the forces acting thereon will suffice.

Figure 2:
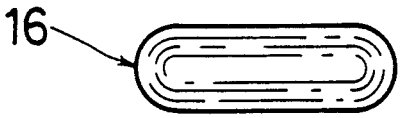
FIGS. 2 to 4 show alternative valve closure members.
Figure 3:
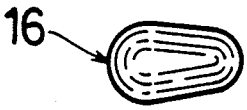
Figure 4:
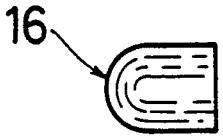

Examples of alternative embodiments of valve closure members are shown in FIGS. 2 to 4. The rounded sides 16 of each of the closure members is intended to contact the valve seat and means, not shown, may, therefore, be provided for holding or guiding the members so that these sides will always come into contact with the valve seat during the closing action. For reasons above set forth these members are not preferred to the ball described.

FIG. 5 illustrates an alternative form of axially contractable member to the bellows member 14 described above. Here a cup-shaped diaphragm 17 forms one wall of a chamber 18 at the end of tube 13. This diaphragm will oscillate under the forces exerted during use of the cleaner and thus provide the cushioning affect referred to above.

It will thus be appreciated that the individual components of the cleaner need not, according to this invention, be confined to those described above. Alternative forms can be used provided that the desired results are achieved.

What I claim as new and desire to secure by Letters Patent is:

1. A device for cleaning surfaces submerged in a liquid comprising a surface contacting head, an inclined passage for flow of liquid through the head, an entrance for flow into the head and an outlet for flow from the head providing at its upstream end a closure valve seat for the outlet, a closure member free to move in the head towards and away from the valve seat and a hollow axially contractable resilient member connected to the outlet at one end with its other end suitable for connection to a flexible suction hose.

2. A device as claimed in claim 1 in which the closure member has a rounded seating surface.

3. A device as claimed in claim 2 in which the closure member is spherical.

4. A device as claimed in 2 in which the closure member or valve seat is resilient.

5. A device as claimed in claim 1 in which a rigid tube forms an extension between the outlet and the axially contractable member.

6. A device as claimed in claim 1 in which the specific gravity of the closure member is only slightly greater than that of the liquid in which the device is to be used.

7. A swimming pool cleaning device operable by a swimming pool suction filtration pump, the device comprising a cleaning head, a water inlet, a flexible member surrounding the inlet for contacting a surface to be cleaned, a water outlet, a flow passage for water between the inlet and the outlet, a hollow axially contractable resilient member between the outlet and means for connection, through a suitable flexible hose, to the inlet opening of a swimming pool filtration pump to induce a flow of water in the flow passage from the inlet to the outlet during use, and a valve in the flow passage, the valve comprising a valve seat and a closure member upstream of the seat and freely movable by water flow through the passage to come into contact with the valve seat, thereby to close the valve, and to rebound from the valve seat, thereby to open the valve.

8. A swimming pool cleaning device as claimed in claim 7 including a rigid tubular outlet extension from the valve seat to the axially contractable member.

9. A swimming pool cleaner as claimed in claim 8 in which resilience is provided between the valve seat and closure member.

10. A swimming pool cleaner as claimed in claim 8 the specific gravity of the closure member is only slightly greater than that of the liquid in which the device is to be used.

* * * * *